US005533730A

United States Patent [19]

Ruvang

[11] Patent Number: 5,533,730

[45] Date of Patent: Jul. 9, 1996

[54] ADJUSTABLE GOLF PUTTER

[76] Inventor: John A. Ruvang, 2018 Grenoble Dr., Carrollton, Tex. 75007

[21] Appl. No.: 545,250

[22] Filed: Oct. 19, 1995

[51] Int. Cl.[6] ..... A63B 53/04; A63B 53/02

[52] U.S. Cl. ..... 473/251; 473/307; 473/313; 473/314; 473/335; 473/341

[58] Field of Search ..... 273/167 R, 168, 273/78, 169, 170, 171, 172, 173, 175, 167 D, 167 F, 167 G, 80 C, 167 H, 167 J, 167 K, 77 R, 81.2, 80.1, 80.2, 164.1, 187.4, 193 R, 194 A, 193 B, 163 R, 79

[56] References Cited

U.S. PATENT DOCUMENTS

| | | | |
|---|---|---|---|
| 1,969,086 | 8/1934 | Luchett . | |
| 2,155,830 | 4/1939 | Howard . | |
| 2,708,579 | 5/1955 | Hugman . | |
| 3,096,982 | 7/1963 | Bassin . | |
| 3,190,651 | 6/1965 | Thomas . | |
| 3,430,957 | 3/1969 | Andis | 273/80.1 |
| 4,073,492 | 2/1978 | Taylor . | |
| 4,519,612 | 5/1985 | Tsao . | |
| 4,655,459 | 4/1987 | Antonious . | |
| 4,736,951 | 4/1988 | Grant . | |
| 4,815,740 | 3/1989 | Williams et al. . | |
| 4,962,932 | 10/1990 | Anderson . | |
| 4,979,744 | 12/1990 | Alcala . | |
| 5,253,869 | 10/1993 | Dingle et al. . | |
| 5,390,919 | 2/1995 | Stubbs et al. . | |
| 5,415,399 | 5/1995 | Kettelson | 273/80.2 |
| 5,429,356 | 7/1995 | Dingle et al. . | |
| 5,470,063 | 11/1995 | Fisher | 273/80.1 |

*Primary Examiner*—Sebastiano Passaniti
*Attorney, Agent, or Firm*—Konneker & Bush

[57] ABSTRACT

An adjustable golf putter provides configurable characteristics of striking face-to-shaft lateral alignment, center of gravity, shaft-to-head longitudinal alignment, head-to-shaft angle, total weight, weight distribution, and targeting. In a preferred embodiment, a golf club has a shaft attached to a putter head, the head having a hosel assembly and weight assemblies clamped between opposing face plates.

20 Claims, 5 Drawing Sheets

ADJUSTABLE GOLF PUTTER

BACKGROUND OF THE INVENTION

The present invention relates generally to golf clubs and, in a preferred embodiment thereof, more particularly provides a golf putter with adjustable characteristics.

Many factors affect the accuracy of a putt in the game of golf, not the least of which are the skill and talent of the person striking the golf ball. Fortunately, as a novice takes the time to practice putting, and as the novice is trained by talented professionals, the novice's skills tend to gradually improve. In general, as the novice's skills improve, purchases are made of different putters, which suit the particular level of the novice's skills at the time the purchases are made.

Even seasoned professionals find that their skills wax and wane from time to time, or that their skills merely change. Accordingly, they must strike a golf ball differently, depending on their skill at the particular time, to maintain their same level of accuracy. For this reason, professionals will often keep an inventory of putters so that they will have putters suited to their skills when they need them.

As with any human endeavor, the game of golf also has its trends and fads. Many times a golf trend has to do with weight distribution in a putter or alignment of the putter striking surface with the golf ball. Some golfers feel compelled to purchase a new putter simply because it is "new".

For all of the above reasons—improving skills, changing skills, and changing trends—a golfer must purchase a number of putters over time. This is a very uneconomical situation, as each golfer really only needs one putter at a time, as long as that putter satisfies the golfer's particular skills, tastes, etc. at that time. This situation may be remedied by a putter which is adjustable in all the various characteristics known to affect putting accuracy. Some of the characteristics of a putter known to affect putting accuracy include striking face-to-shaft lateral alignment, center of gravity, head-to-shaft angle, total weight, weight distribution, and targeting.

Adjustable putters are well known in the art, but none of the putters proposed heretofore have offered a combination of adjustments which would enable a golfer to configure the putter adequately to suit the golfer's needs at any time. Some proposed adjustable putters provide for one or a few of the adjustments set out above, but are cumbersome in operation or too expensive to manufacture.

From the foregoing, it can be seen that it would be quite desirable to provide an adjustable putter which enables a golfer to adjust the characteristics of the putter to suit the golfer's needs. It is accordingly an object of the present invention to provide such an adjustable golf putter which is economical to produce, economical to own, and easy to configure.

SUMMARY OF THE INVENTION

In carrying out the principles of the present invention, in accordance with an embodiment thereof, an adjustable putter is provided which has configurable characteristics of striking face-to-shaft lateral alignment, center of gravity, head-to-shaft angle, total weight, weight distribution, and targeting. The construction is modular, making it economical to produce and convenient to adjust.

In broad terms, an adjustable putter head for attachment to a shaft is provided which includes a first elongated hosel member, the first hosel member having a hole formed on a first opposite end thereof for attachment of the shaft to the first hosel member, a spaced series of indentations formed on a second opposite end thereof, and a first aperture formed through the first hosel member intermediate said first and second opposite ends, a second elongated hosel member adjacent the first hosel member, the second hosel member having a spaced series of projections formed on a first opposite end thereof, the projections being complimentarily shaped to engage the first hosel member indentations, and a second aperture formed through the second hosel member on a second opposite end thereof, the second aperture aligning with the first aperture when the indentations engage the projections, a fastener extending through the first and second apertures and forming a pivot about which the first and second hosel members rotate with respect to each other, and a face plate attached to the first and second hosel members.

Another adjustable putter head is also provided for use in a golf game to strike a golf ball, the putter head attaching to a shaft and including an elongated plate having a generally planar striking surface formed thereon for striking the ball, the striking surface having a spatial relationship to the shaft, the plate further having first and second opposite end portions, and a first spaced series of teeth formed on a side surface opposite the striking surface and extending from the first end portion to the second end portion, and a hosel assembly, the hosel assembly having a shaft attachment portion and a plate attachment portion formed thereon, the plate attachment portion having a second spaced series of teeth formed thereon for engagement with the first spaced series of teeth, the hosel assembly attaching the shaft to the plate and being capable of altering the spatial relationship of the striking surface to the shaft.

The use of the disclosed adjustable golf putter eliminates the need for a golfer to purchase new and various putters as the golfer's skills and tastes change.

DETAILED DESCRIPTION

Figure 1:
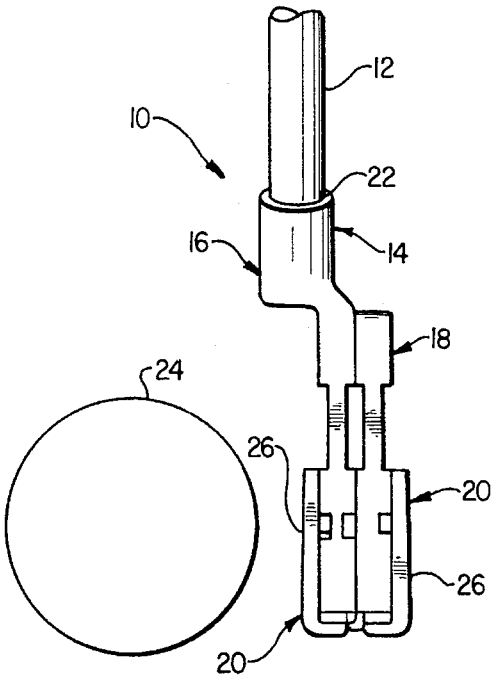
FIG. 1 is a rear elevational view of an adjustable putter embodying principles of the present invention.

Illustrated in FIG. 1 is an adjustable putter 10 which embodies principles of the present invention. The adjustable putter 10 includes a conventional shaft 12 and a head 14. The head 14 includes a hosel major 16, a hosel minor 18, and face plate portions 20.

The shaft 12 is joined to the head 14 at a hole 22 in the hosel major 16. The shaft 12 may be secured in the hole 22 by gluing, press fitting, threading, or any other method of attachment, permanent or releasable. The preferred method of attachment is by gluing with an epoxy resin.

In this view, the hosel major 16 is disposed laterally closer to a golf ball 24 than is the hosel minor 18. Thus, if the ball 24 is to be struck by swinging the putter head 14 from right to left as viewed in FIG. 1, the face plate portion 20 adjacent the hosel major 16 will contact the ball 24 at a striking face 26 of the face plate portion 20. Note that the striking face 26 on the face plate portion 20 adjacent the hosel major 16 is positioned approximately directly below, and aligned with, the shaft 12.

The hosel major 16 and hosel minor 18 are releasably fastened together so that their lateral positions may be interchanged, thereby changing the alignment with respect to the shaft 12 of the striking face 26 which contacts the ball 24. The manner in which this striking face-to-shaft lateral alignment may be adjusted will be appreciated further with consideration of the representatively illustrated adjustable putter 10 as viewed in FIG. 2 and the written description thereof below.

Figure 2:
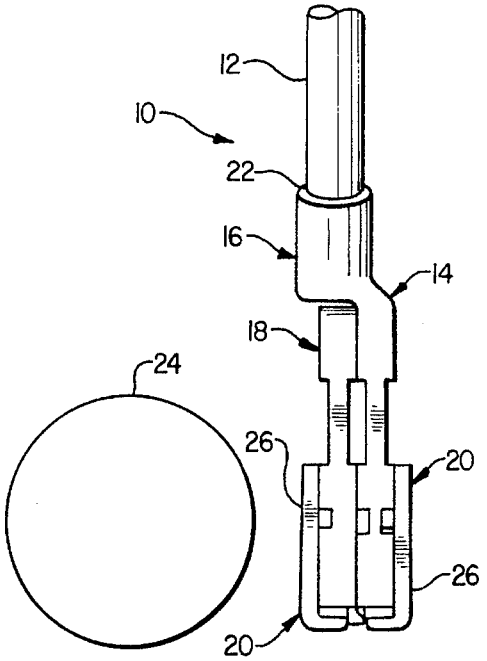
FIG. 2 is a rear elevational view of the adjustable putter of FIG. 1, following lateral adjustment of its striking face-to-shaft alignment.

Turning now to FIG. 2, the adjustable putter 10 is shown with the lateral positions of the hosel major 16 and the hosel minor 18 reversed from those seen in FIG. 1. Note that, if the putter 10 is swung from right to left as viewed in FIG. 2, the striking face 26 on the face plate portion 20 adjacent the hosel minor 18 will now contact the ball 24.

The striking face 26 which contacts the ball 24 is laterally closer to the ball 24 relative to the shaft 12 as compared to the striking face 26 which contacts the ball 24 as illustrated in FIG. 1. Thus, the striking face 26 will contact the ball 24 sooner when the putter 10 is configured as shown in FIG. 2 as compared to the putter 10 as shown in FIG. 1.

Figure 3:
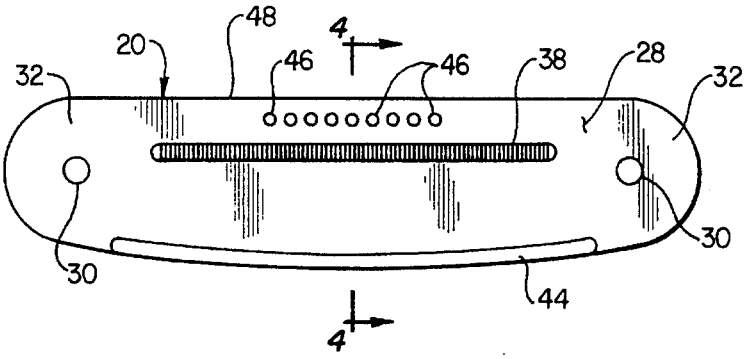
FIG. 3 is an elevational view of an inner surface of a face plate portion of the adjustable putter of FIG. 1.

Turning now to FIG. 3, an inner surface 28 of the face plate portion 20 may be seen, separated from the remainder of the adjustable putter 10. Two holes 30 extend laterally through either opposite end 32 of the face plate portion 20. The holes 30 permit insertion therethrough of fasteners 40 (see FIG. 12) to releasably join the face plate portions 20, hosel minor 18, hosel major 16, end weight assemblies 34 (see FIG. 11), and target 36 (see FIG. 15).

Figure 12:
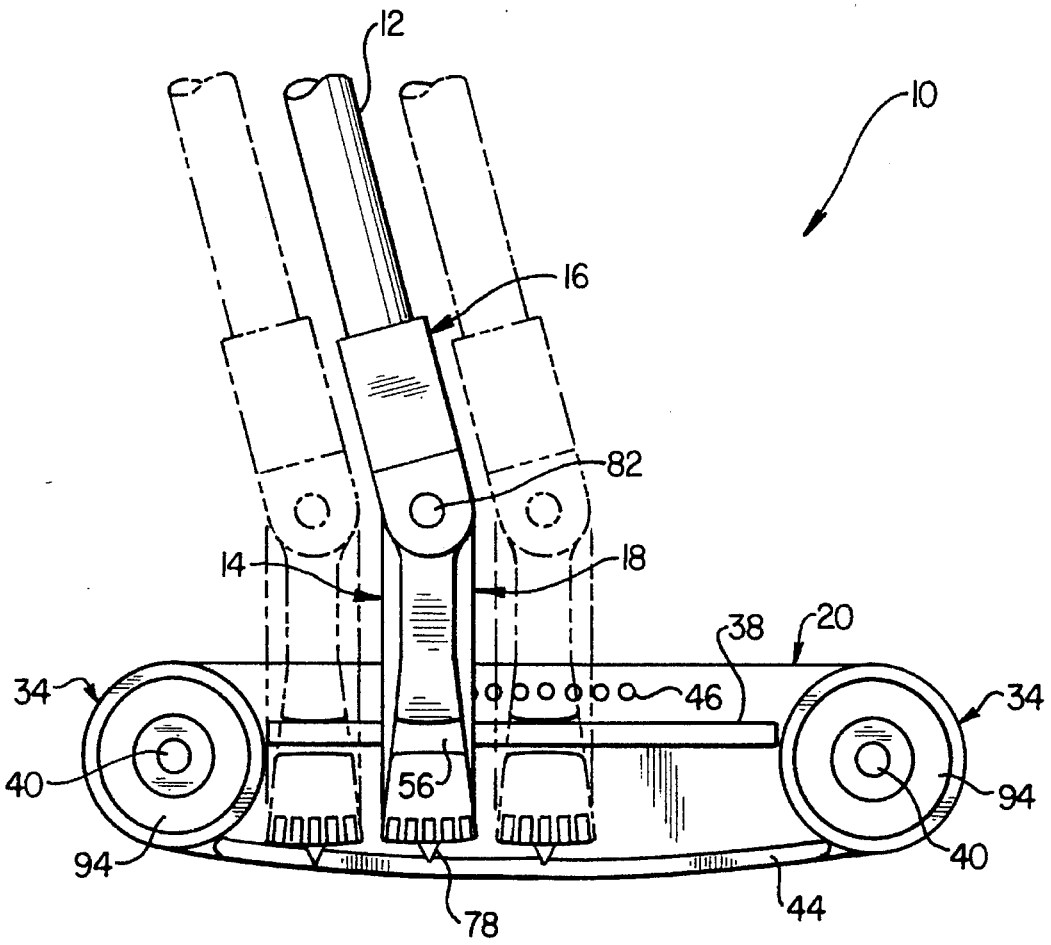
FIG. 12 is a side elevational view of the adjustable putter with one of the face plate portions removed therefrom, showing a center of gravity adjustment thereof.

The face plate portion 20 permits longitudinal adjustment of the hosel minor 18 and hosel major 16 between opposing face plate portions 20. A splined or toothed rail 38 extends along the length of the face plate portion 20 and operatively engages complementarily shaped teeth on toothed slot 42 (see FIG. 9) formed on the hosel minor 18. Thus, the hosel minor 18 may be disposed along the length of the toothed rail 38 to thereby adjust the longitudinal position of the hosel major 16, hosel minor 18, and shaft 12 (which are each attached to the others) relative to the face plate portions 20. The manner in which this adjustment affects weight distribution and center of gravity of the putter 10 will be more fully appreciated with consideration of the adjustable putter as illustrated in FIG. 12 and the written description thereof below.

The face plate portion 20 also includes a series of longitudinally spaced and laterally extending holes 46 disposed between the toothed rail 38 and an upper surface 48 of the face plate portion 20. As will be more fully described below, holes 46 allow longitudinal adjustment of the target 36 (see FIG. 15). The target 36 extends laterally into the holes 46 on each opposing face plate portion 20 and is captured therebetween when the putter head 14 is assembled.

As representatively illustrated herein, the face plate portions 20 are identical to each other. It is to be understood that they are also mirror images of each other. The face plate portion 20, which is disposed on the putter head 14, opposite the other face plate portion 20 disposed on the putter head 14 to strike the ball 24, may be considered as a clamping member, used to clamp the hosel major 16, hosel minor 18, and end weight assemblies 34 (see FIG. 11) to the other face plate portion 20.

Figure 4:
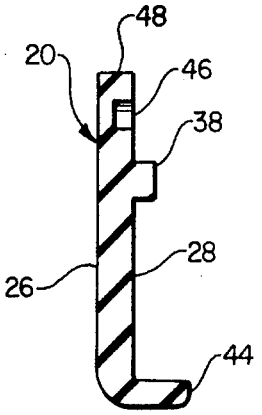
FIG. 4 is an enlarged cross-sectional view of the face plate portion, taken along line 4—4 of FIG. 3.

Illustrated in FIG. 4 is a cross-sectional view of the face plate portion 20 illustrated in FIG. 3, taken along line 4—4. In this view, it can be seen that the toothed rail 38 extends outwardly from the inner surface 28, and the hole 46 extends into, but not through, the face plate portion. Extending inwardly from the inner surface 28 is a sole plate 44.

Figure 5:
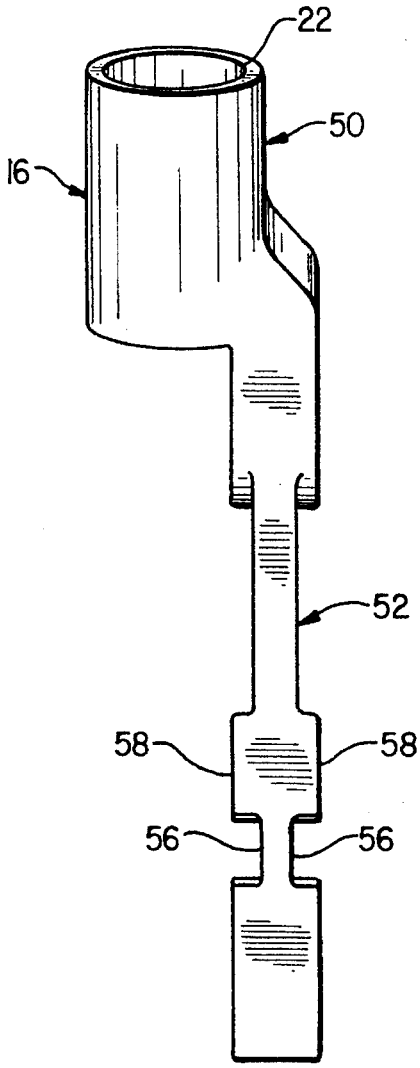
FIG. 5 is an enlarged rear elevational view of a hosel major portion of the adjustable putter.

FIG. 5 shows the hosel major 16, apart from the remainder of the adjustable putter 10. An upper portion 50 of the hosel major 16 is angled with respect to a lower portion 52 of the hosel major 16. The upper portion 50 includes hole 22, into which the shaft 12 (see FIG. 1) attaches. Lower portion 52 includes slots 56 extending inwardly into side surfaces 58. The slots 56 also extend laterally across the side surfaces 58 (see FIG. 6) and permit reception thereinto of the toothed rail 38 (see FIG. 3).

Figure 6:
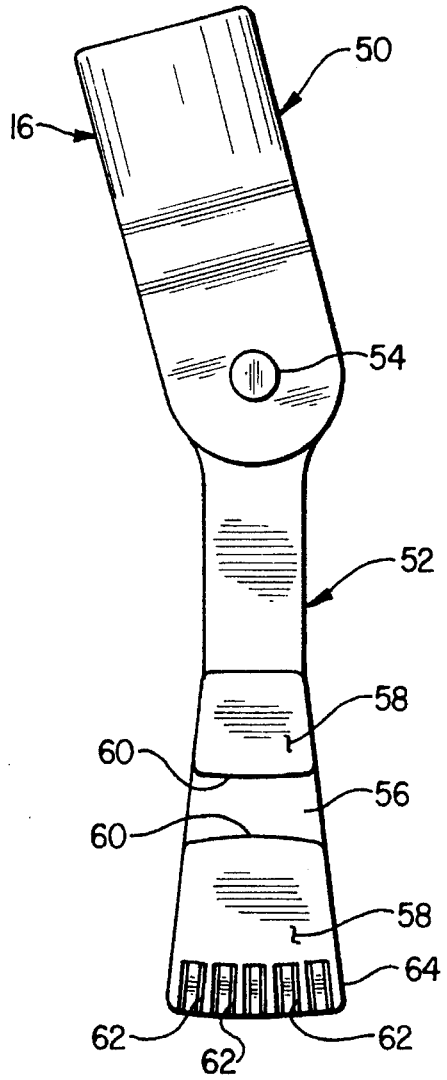
FIG. 6 is an enlarged side elevational view of the hosel major portion of the adjustable putter.

FIG. 6 shows a side view of the hosel major 16, wherein the angular relationship between upper portion 50 and lower portion 52 may be seen. Slot 56 has curved side portions 60 to allow for angular adjustment of the hosel major 16 with respect to the toothed rail 38 (which is received in the slots 56) when the putter head 14 is assembled. The manner in which the angular adjustment is made will be more fully understood with consideration of FIG. 14 and accompanying description below.

Hole 54 extends laterally through the upper portion 50. A fastener 82 (see FIG. 12) is inserted through the hole 54 in order to clamp the hosel major 16 to the hosel minor 18 and fix their angular and lateral relationship to each other.

Angular teeth 62 formed on side surface 58 at lower end 64 engage complimentarily shaped teeth 76 (see FIG. 9) on the hosel minor 18 to prevent angular movement of the hosel major 16 with respect to the hosel minor 18 after the hosel major and hosel minor are clamped together.

Figure 7:
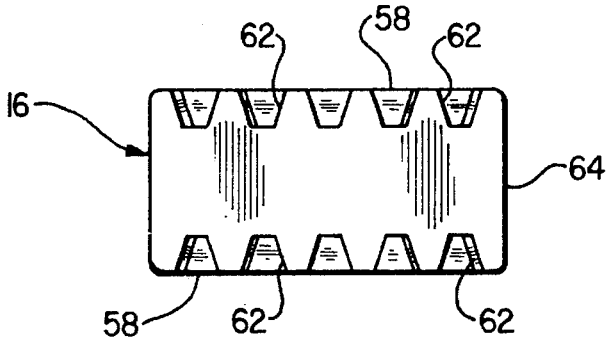
FIG. 7 is an enlarged bottom plan view of the hosel major portion of the adjustable putter.

FIG. 7 shows angular teeth 62 extending inwardly into side surfaces 58 at lower end 64 of the hosel major 16.

Figure 8:
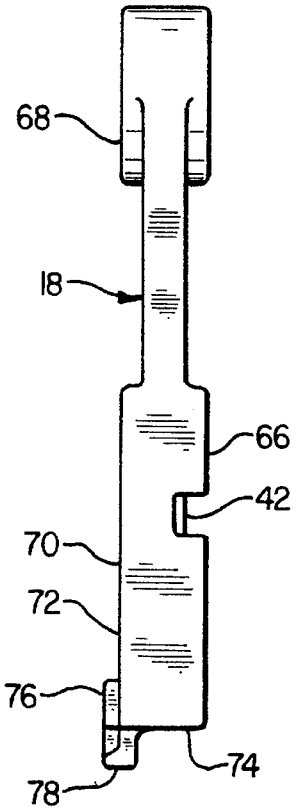
FIG. 8 is an enlarged rear elevational view of a hosel minor portion of the adjustable putter.

Illustrated in FIG. 8 is the hosel minor 18, separated from the remainder of the adjustable putter 10. Hosel minor 18 includes upper portion 68 and lower portion 70.

In this view, a splined or toothed slot 42 may be seen extending inwardly on side surface 66. The toothed slot 42 is complimentarily configured to engage the toothed rail 38 (see FIG. 3). When the putter head 14 is assembled, toothed rail 38 is received into toothed slot 42, thereby allowing side surface 66 to contact and bear upon inner surface 28 of face plate portion 20 (see FIG. 3).

Angular teeth 76 extend outwardly on side surface 72 at lower end 74 of the hosel minor 18. Angular teeth 76 are complimentarily shaped for engagement with angular teeth 62 formed on the hosel major 16 (see FIG. 6). As described hereinabove the angular teeth 76 and 62 fix the angular relationship of the hosel major 16 with respect to the hosel minor 18 when they are clamped together.

Indicator point 78 extends downwardly from the lower end 74 as viewed in FIG. 8. Indicator point 78 also forms a portion of an angular tooth 76. The purpose of the indicator point 78 is to indicate the relative position of the hosel minor 18 with respect to the face plate portions 20 in a manner that will be more fully described hereinbelow in the written description accompanying FIG. 13.

Note that, however the head 14 is assembled (see FIGS. 1 and 2), side surface 72 of the hosel minor 18 contacts one of the side surfaces 58 of the hosel major 16 so that side surface 66 of the hosel minor 18 always faces outwardly, thereby permitting angular teeth 62 and 76 to cooperatively engage, and permitting toothed slot 42 and toothed rail 38 to cooperatively engage.

Figure 9:
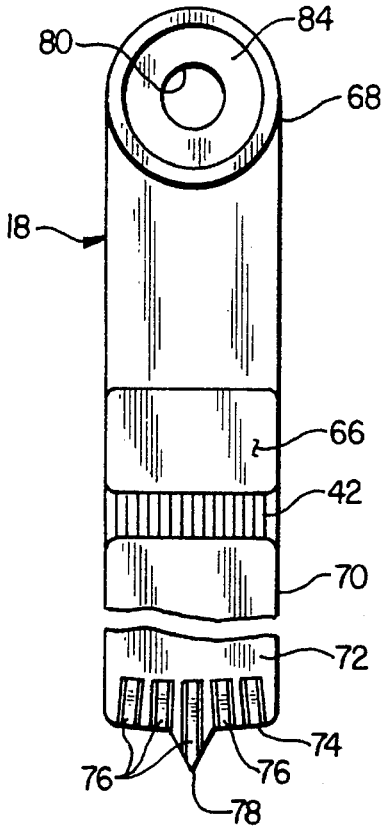
FIG. 9 is an enlarged side elevational view of the hosel minor portion of the adjustable putter.

FIG. 9 shows a side view of the hosel minor 18 in two portions so that both the angular teeth 76 and toothed slot 42 may be seen clearly. Upper portion 68 of the hosel minor 18, as representatively illustrated in FIG. 9, includes a hole 80 extending therethrough which aligns with hole 54 of the hosel major 16 (see FIG. 6), so that the fastener 82 (see FIG. 12) may clamp the hosel minor 18 to the hosel minor 16. Countersink 84 is recessed into the upper portion 68 so that the fastener 82 does not protrude outwardly from the hosel minor 18.

Adjacent lower end 74, angular teeth 76 may be seen formed on side surface 72. Note that indicator point 78, which extends downwardly from the lower end 74 as viewed in FIG. 9, is aligned with one of the angular teeth 76.

Figure 10:
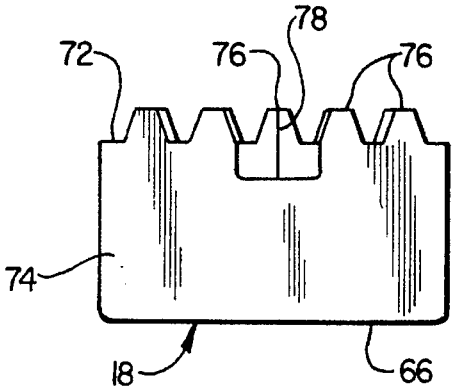
FIG. 10 is an enlarged bottom plan view of the hosel minor portion of the adjustable putter.

Turning now to FIG. 10, an enlarged bottom plan view of the lower end 74 of the hosel minor 18 may be seen. In this view, the manner in which the angular teeth 76 extend outwardly from the side surface 72, and the relationship of the indicator point 78 to the angular teeth 76 are clearly shown.

Figure 11:
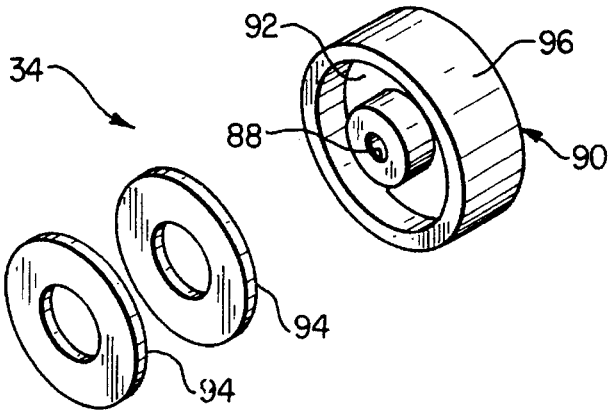
FIG. 11 is a perspective view of an end weight assembly portion of the adjustable putter.

FIG. 11 shows the end weight assembly 34, two of which are used in the putter head 14 (see FIG. 15) at opposite ends 32 of the face plate portions 20. Fasteners 40 (see FIG. 14) extend through hole 88 formed in each end weight housing 90 to secure the end weight assemblies 34 between the face plate portions 20.

An annular recess 92, formed in the end weight housing 90, allows the insertion of multiple complimentarily shaped weight disks 94, two of which are representatively illustrated in FIG. 11. Thus, as will be readily appreciated by one of ordinary skill in the art, the total weight of the putter 10 may be adjusted by adding or removing one or more of the weight disks 94 from the end weight housings 90. Additionally, the weight disks 94 may be made of a variety of materials having various densities, and may be of various thicknesses, etc., so that the weight disks 94 may have different weights.

A person of ordinary skill in the art will also readily appreciate that, by varying the weight present in each of the two end weight assemblies 34, the weight distribution and, thus, the center of gravity, in the putter 10 can be adjusted. Specifically, the rotational moment of inertia of the putter head 14 about the striking face 26 of the face plate portion 20 where the ball 24 makes contact (see FIG. 1) can be adjusted with ease.

Note that transverse face 96 of the end weight housing 90 is slightly smaller in thickness than the clamped together thickness of the hosel major 16 and hosel minor 18, so that when fasteners 86 are tightened to secure the end weight assemblies 34 between the face plate portions 20, the hosel major 16 and hosel minor 18 are further clamped together.

In FIG. 12, a manner in which the longitudinal relationship between the shaft 12 and the putter head 14 can be adjusted is shown. One of the face plate portions 20 is removed by releasing fasteners 40, thereby unclamping the hosel minor 18 and hosel major 16 and permitting longitudinal movement of the hosel major and hosel minor along the remaining face plate portion 20.

Toothed slot 42 (not visible in FIG. 12) on the hosel minor 18 is disengaged from the toothed rail 38 on the remaining face plate portion 20 and moved longitudinally, either to a position to the right or to the left as representatively illustrated in FIG. 12 by the hosel minor 18, hosel major 16, and shaft 12 drawn in phantom lines. The toothed slot 42 is then engaged with the toothed rail 38 (for illustrative clarity, the teeth on the toothed rail are not shown in FIG. 12), and the previously removed face plate portion 20 is reinstalled by tightening fasteners 40.

As will be readily apparent to one of ordinary skill in the art, the center of gravity of the head 14 will change as the hosel major 16 and hosel minor 18 are moved longitudinally between the end weight assemblies 34. Note also that, as the hosel minor 18 is moved longitudinally with respect to the face plate portions 20, the indicator point 78 moves longitudinally with respect to the sole plates 44.

Figure 13:
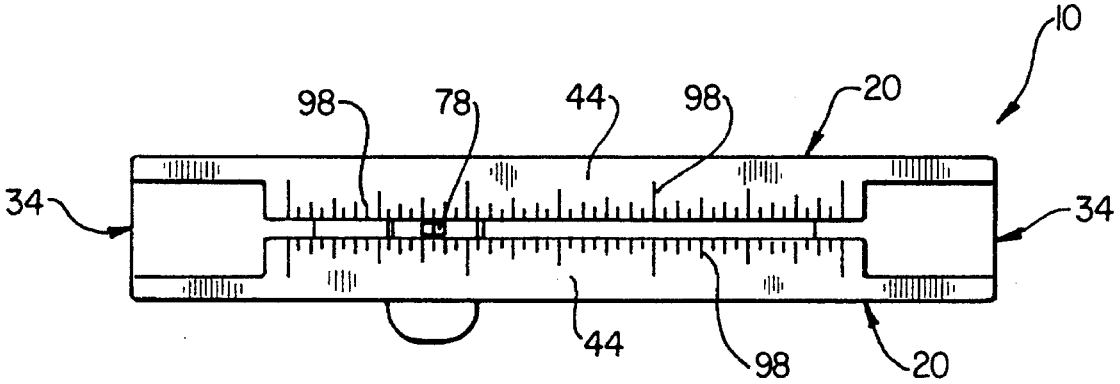
FIG. 13 is a bottom plan view of the adjustable putter.

Illustrated in FIG. 13 is a bottom view of the putter 10, showing sole plates 44 of the face plate portions 20. In this view, graduations 98 formed on the sole plates 44 may be seen. These graduations 98 may be marked in any convenient scale, such as inches or centimeters, and may be engraved, stamped, imprinted, or applied by any convenient method.

As described above, the indicator point 78 moves longitudinally with respect to the sole plates 44 as the hosel minor 18 is moved longitudinally along the toothed rail 38. The graduations 98 on the sole plates 44 provide a convenient reference for determining how far the indicator point 78, and, thus, the hosel minor 18, has been moved longitudinally with respect to the face plate portions 20.

Figure 14:
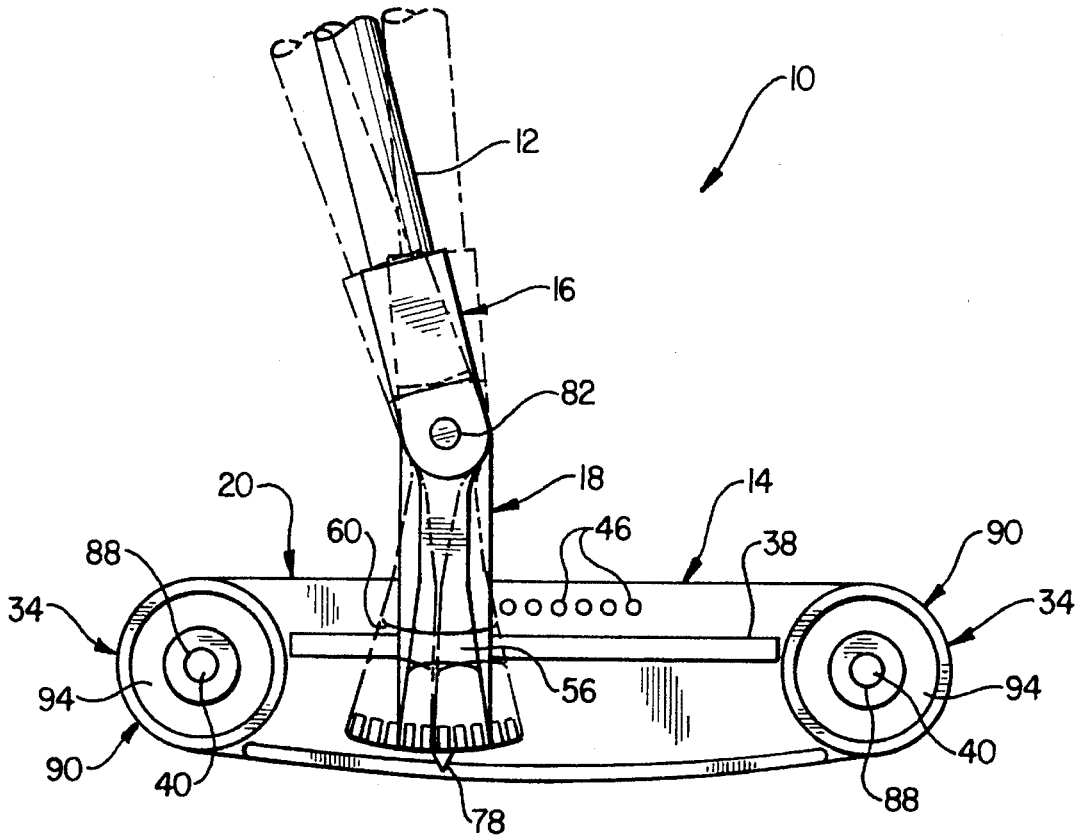
FIG. 14 is a side elevational view of the adjustable putter with one of the face plate portions removed therefrom, showing a head-to-shaft angle adjustment.

Turning now to FIG. 14, the manner in which the angular relationship between the shaft 12 and the putter head 14 can be adjusted is representatively illustrated. One of the face plate portions 20 has been removed by loosening fasteners 40 so that the hosel major 16 and hosel minor 18 may be removed from between them. Additionally, the fastener 82 must be loosened so that the angular teeth 62 on the hosel major 16 (see FIG. 6) may be disengaged from the angular teeth 76 on the hosel minor 18 (see FIG. 9).

The hosel major 16 (to which the shaft 12 is attached) is then rotated about fastener 82 with respect to the hosel minor 18 until the desired angular relationship is selected. Rotations of the hosel major 16 and shaft 12 clockwise and counterclockwise as viewed in FIG. 14 are shown in phantom lines. Note that the hosel minor 18 remains stationary in its longitudinal position on the toothed rail 38 (on which no teeth are shown for illustrative clarity). Note also that the curved side portions 60 of the slots 56 on the hosel major 16 allow rotation of the hosel major without interference from the toothed rail 38.

The fastener 82 is then tightened to clamp the hosel major 16 and hosel minor 18 together, thereby engaging the angular teeth 62 and 76. The previously removed face plate portion 20 is reinstalled and fasteners 40 are retightened to clamp the hosel major 16 and hosel minor 18 between the face plate portions 20.

Figure 15:
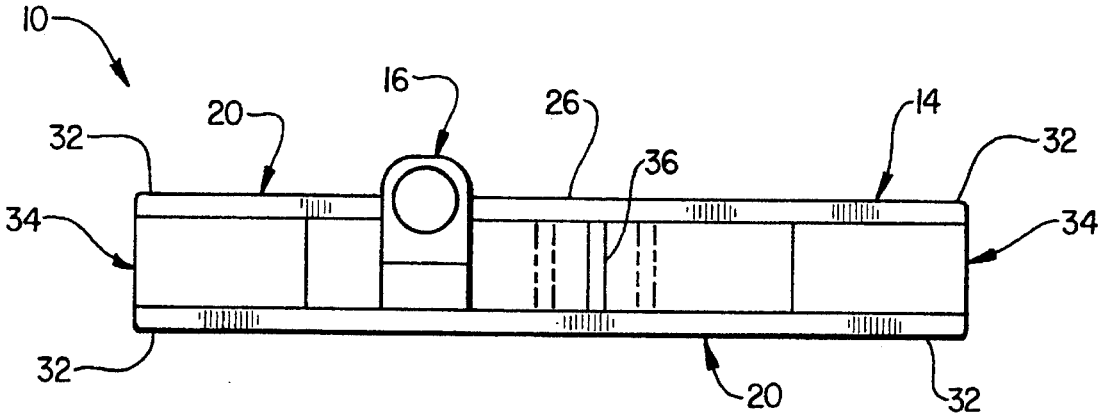
FIG. 15 is a top plan view of the adjustable putter, showing a targeting adjustment thereof.

In FIG. 15, the target 36 may be seen installed between the face plate portions 20. The target 36 is used in aligning the ball 24 (see FIG. 1) with the striking face 26. To adjust targeting, one of the face plate portions 20 is removed and the target 36 is moved to another pair of opposite aligned holes 46 and the previously removed face plate portion 20 is reinstalled. The target 36 is preferably colored so that it is easily seen, the preferred color being red.

The preferred material of which all of the parts of the putter head 14 are made is steel, although other materials may be substituted without deviating from the principles of the present invention. Materials may be substituted, for example, to adjust the putter head 14 weight, strength, strength-to-weight ratio, flexibility, etc., in keeping with the principles of the present invention. In particular, as described above, the weight disks 94 may be made of various materials to adjust their weight.

The foregoing detailed description is to be clearly understood as being given by way of illustration and example only, the spirit and scope of the present invention being limited solely by the appended claims.

What is claimed is:

1. An adjustable putter head for attachment to a shaft, the putter head comprising:

a first elongated hosel member, said first hosel member having a hole formed on a first opposite end thereof for attachment of the shaft to said first hosel member, a spaced series of indentations formed on a second opposite end thereof, and a first aperture formed laterally through said first hosel member intermediate said first and second opposite ends;

a second elongated hosel member adjacent said first hosel member, said second hosel member having a spaced series of projections formed on a first opposite end thereof, said projections being complimentarily shaped to engage said first hosel member indentations, and a second aperture formed laterally through said second hosel member on a second opposite end thereof, said second aperture aligning with said first aperture when said indentations engage said projections;

a fastener extending through said first and second apertures and forming a pivot about which said first and second hosel members rotate with respect to each other; and a face plate attached to said first and second hosel members, whereby the shaft may be conveniently rotated with respect to said face plate by pivoting said first hosel member with respect to said second hosel member about said fastener.

2. The adjustable putter head according to claim 1, wherein said first hosel member further comprises first and second opposite side surfaces, each of said first and second side surfaces having said spaced series of indentations formed thereon, whereby said second hosel member may be placed adjacent either of said first and second side surfaces to engage said projections with said indentations.

3. The adjustable putter head according to claim 2, wherein said first hosel member further comprises upper and lower portions, said upper portion being laterally offset from said lower portion, such that when said second hosel member is placed adjacent said first side surface of said first hosel member, the shaft has a first relationship to said face plate, and when said second hosel member is placed adjacent said second side surface of said first hosel member, the shaft has a second relationship to said face plate, said second relationship being laterally offset from said first relationship.

4. The adjustable putter head according to claim 1, wherein:

said second hosel member has a slot formed thereon intermediate said second aperture and said projections, said slot having a first spaced series of teeth formed thereon; and said face plate has a longitudinally extending rail formed thereon, said rail being complimentarily shaped for insertion into said slot, and said rail having a second spaced series of teeth formed thereon, said second teeth being complimentarily shaped to engage said first teeth when said rail is inserted in said slot, whereby said second hosel member may be longitudinally positioned on said face plate by inserting said rail in said slot and engaging said first and second teeth.

5. The adjustable putter according to claim 1, wherein said face plate further has first and second opposite ends, and further comprising two weight assemblies attached to said face plate first and second opposite ends, each of said weight assemblies comprising a plurality of weight members, such that said weight members may be selectively attached to said weight assemblies, whereby said weight members may be selectively attached at said first and second opposite ends of said face plate.

6. The adjustable putter according to claim 1, wherein said face plate further has a longitudinally spaced series of third apertures formed thereon, and further comprising a target member complimentarily shaped for insertion into said third apertures, whereby said target member may be positioned longitudinally on said face plate by inserting said target member into a selected one of said third apertures.

7. The adjustable putter according to claim 1, wherein said second hosel member further has an indicator pointer formed thereon, and said face plate further has a longitudinally spaced series of graduations formed thereon, such that said pointer aligns with a selected one of said graduations when said second hosel member is attached to said face plate.

8. For use in a golf game to strike a golf ball, an adjustable putter head for attachment to a shaft, the putter head comprising:

an elongated plate having a generally planar striking surface formed thereon for striking the ball, said striking surface having a spatial relationship to the shaft, said plate further having first and second opposite end portions, and a first spaced series of teeth formed on a side surface opposite said striking surface and extending from said first end portion to said second end portion; and a hosel assembly, said hosel assembly having a shaft attachment portion and a plate attachment portion formed thereon, said plate attachment portion having a second spaced series of teeth formed thereon for engagement with said first spaced series of teeth, said hosel assembly attaching the shaft to said plate and being capable of altering said spatial relationship of said striking surface to the shaft.

9. The putter head according to claim 8, wherein said hosel assembly comprises a first hosel member and a second hosel member, said first and second hosel members being releasably and pivotally attached to each other, and each of said first and second hosel members having complimentarily shaped splines formed thereon, such that when said first and second hosel members are released said splines are disengageable and said first and second hosel members may be pivoted with respect to each other and when said first and second hosel members are attached to each other said splines engage and said first and second hosel members are secured against pivotal movement relative to each other.

10. The putter head according to claim 8, further comprising two weight members, each of said weight members being attached to one of said first and second opposite end portions of said plate.

11. The putter head according to claim 10, wherein said weight members each comprise a plurality of removably secured weight disks.

12. The putter head according to claim 8, further comprising a clamping member, said clamping member being configured for clamping said hosel assembly between said plate and said clamping member.

13. The putter head according to claim 12, wherein said clamping member is formed as a structural mirror image to said plate.

14. The putter head according to claim 12, wherein said plate and said clamping member each have an aligned and longitudinally spaced series of holes formed on opposing side surfaces of said clamping member and said plate, and further comprising an elongated target member received in and extending between a pair of said opposing aligned holes.

15. A golf club, comprising:

a shaft;

a hosel major, said hosel major being rigidly attached to said shaft and having a first spaced series of projections formed thereon;

a hosel minor adjacent said hosel major, said hosel minor being pivotably attached to said hosel major and having second and third spaced series of projections formed thereon, said second spaced series of projections complimentarily engaging said first spaced series of projections to prevent pivotal movement of said hosel minor relative to said hosel major;

two weight assemblies;

two face plates, each of said face plates having a fourth spaced series of projections formed on an inside surface thereof, one of said fourth spaced series of projections complimentarily engaging said third spaced series of projections, said face plates being disposed so that said inside surfaces are in a facing, spaced apart relationship; and two fasteners clamping said hosel major, said hosel minor, and said two weight assemblies intermediate said two face plates.

16. The golf club according to claim 15, further comprising a target member extending into holes formed on each of said face plate inside surfaces and intermediate a facing pair of said holes.

17. The golf club according to claim 15, wherein said weight assemblies each comprise a housing, said housing having an opening formed therein, and a weight member received in said opening.

18. The golf club according to claim 15, wherein said hosel minor further has an indicator point extending therefrom, and each of said face plates further has a spaced series of graduations formed thereon, such that when said third projections engage said fourth projections, said indicator point aligns with one of said graduations.

19. The golf club according to claim 15, wherein said hosel major further comprises a shaft attachment portion and a hosel minor attachment portion, said shaft attachment portion being rigidly attached to said shaft, said hosel minor attachment portion being pivotably attached to said hosel minor, and said shaft attachment portion being laterally offset from said hosel minor attachment portion.

20. The golf club according to claim 19, wherein said hosel major hosel minor attachment portion has first and second opposite side surfaces, each of said first and second opposite side surfaces having said first spaced series of projections formed thereon, such that said hosel minor may be pivotably attached to a selected one of said first and second opposite side surfaces.

* * * * *